United States Patent [19]

Charland et al.

[11] Patent Number: 4,986,373

[45] Date of Patent: Jan. 22, 1991

[54] POST HOLE DIGGER

[75] Inventors: Guy Charland, Lavaltrie; Robert Beaudoin, Mascouche, both of Canada

[73] Assignee: Les Industries L.T.A. Inc./L.T.A. Industries Inc., St-Laurent, Canada

[21] Appl. No.: 422,080

[22] Filed: Oct. 16, 1989

[51] Int. Cl.[5] ..... E21B 10/42; E21B 10/60; E02D 7/24

[52] U.S. Cl. ..... 175/21; 52/155; 175/391; 175/393; 175/421; 175/424; 405/248; 405/254

[58] Field of Search ..... 175/424, 21, 20, 18, 175/67, 324, 391, 392, 393, 421, 397, 327; 405/248, 253, 254; 52/154, 155

[56] References Cited

U.S. PATENT DOCUMENTS

| | | | |
|---|---|---|---|
| 63,016 | 3/1867 | Caswell | 175/393 X |
| 225,061 | 3/1880 | Johnson | 405/248 |
| 228,467 | 6/1880 | Maclay | 405/254 |
| 283,300 | 8/1883 | Surprenant et al. | 405/248 |
| 427,815 | 5/1890 | Wolf | 52/155 X |
| 629,539 | 7/1899 | Bertram | 175/18 |
| 2,508,230 | 5/1950 | Coon | 175/18 |
| 2,864,241 | 12/1958 | Fiore et al. | 405/254 |
| 3,218,813 | 11/1965 | Fiore | 405/254 |
| 3,638,741 | 2/1972 | Zizak | 175/424 X |

FOREIGN PATENT DOCUMENTS

| | | | |
|---|---|---|---|
| 2406699 | 6/1979 | France | 175/424 |

*Primary Examiner*—Hoang C. Dang

[57] ABSTRACT

A post hole digger and a method of implanting a post in the ground. A boring implement having a piercing free end and also having an attachment flange is secured to an end portion of a post to be implanted in the ground. The implement has a tapered body section with a projecting serrated edge on opposed sides thereof. The serrated edges extend angularly from a common longitudinal plane and in opposed angular directions. A pipe section is secured to the implement and a garden hose is connected thereto whereby to direct a stream of water in the direction of said piercing free end whereby axial rotation and counter-rotation of said post causes the implement to bore into the ground to cause said post to descend in a bore hole. After the post is implanted the garden hose is disconnected from the pipe section by applying a pulling force on the hose.

9 Claims, 2 Drawing Sheets

POST HOLE DIGGER

BACKGROUND OF THE INVENTION

1. Field of Invention

The present invention is directed to a post hole digging implement and a method of implanting a post into the ground by imparting axial rotation and counter-rotation to the pole to cause the boring implement secured under the post to bore a hole and wherein a liquid flow is directed in the direction of a piercing free end of said boring implement to facilitate penetration into the ground.

2. Description of Prior Art

Various types of post hole diggers are known for digging holes into the ground. It is also known to secure hole diggers directly to the free end of the post and wherein the boring implement is left into the ground after the hole has descended to its desired depth. In the majority of these known devices, the post is descended into the ground by applying a force in the axial direction of the post and this is done by hammering the top end of the post. The disadvantage of this type of post implantation is that it is very straineous and often the post is damaged by the blows which are imparted to the top end thereof In order to protect the post, it is known to place a protective cap over the top end of the post but this has not been proven to be entirely satisfactory

SUMMARY OF INVENTION

It is a feature of the present invention to provide a post hole digger and a method of implanting a post in the ground, which substantially overcomes the deficiencies in the known prior art.

Another feature of the present invention is to provide a post hole digger wherein a boring implement is connected to an end of the post to be implanted into the ground and wherein a conduit means is secured to the implement to removably connect thereto a conduit, such as a garden hose, whereby to apply water pressure in the direction of a boring free end of the implement.

Another feature of the present invention is to provide a post hole digger which is implanted into the ground by imparting axial rotation and counter-rotation to the post while at the same time applying water pressure in the direction of a boring free end of the implement.

Another feature of the present invention is to provide a method of implanting a post in the ground which method comprises imparting axial rotation and counter-rotation to the post while at the same time applying water pressure in the direction of a boring implement connected to the descending free end of the post and disconnecting water pressure from the implement, after the post is implanted.

According to the above features, from a broad aspect, the present invention provides a post hole digger comprising a boring implement having a piercing free end and an attachment means at an opposed end for securement to an end of a post to be secured in the ground. The implement has a tapered body section with a projecting serrated edge on opposed sides thereof The serrated edges extend angularly from a common longitudinal plane and in opposed planar angular directions. Conduit means is secured to the implement to direct a liquid flow in the direction of the piercing free end.

According to a further broad aspect of the present invention, there is provided a method of implanting a post in the ground. The method comprises securing the boring implement as described in the preceding paragraph to an end of a post to be implanted in the ground. A conduit is connected to a open top end of the conduit means of the implement. Water pressure is applied to the conduit to direct a stream of water in the direction of the piercing free end. Axial rotation and counter-rotation movement is imparted to the post to cause the implement to bore a hole under the post.

BRIEF DESCRIPTION OF DRAWINGS

A preferred embodiment of the present invention will now be described with reference to the accompanying drawings in which.

DESCRIPTION OF PREFERRED EMBODIMENT

Figure 1:
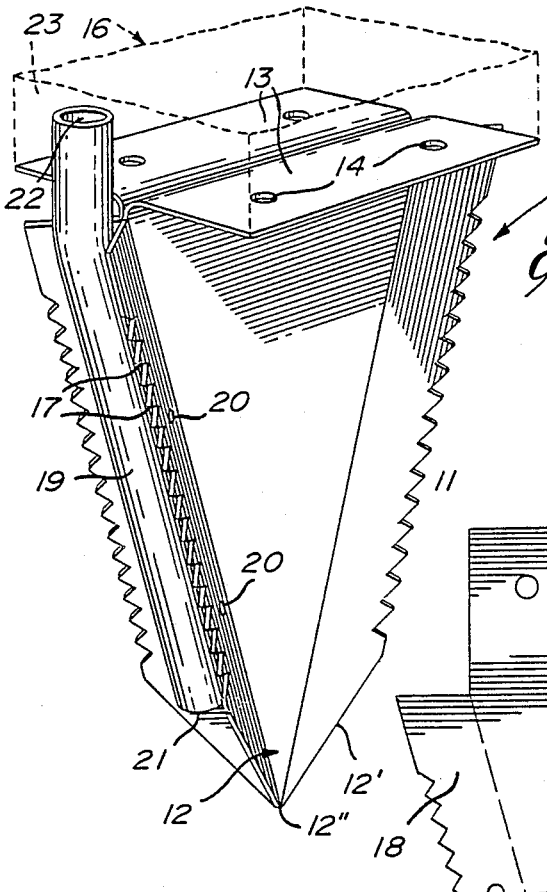
FIG. 1 is a perspective view of the boring implement of the present invention.
Figure 3:
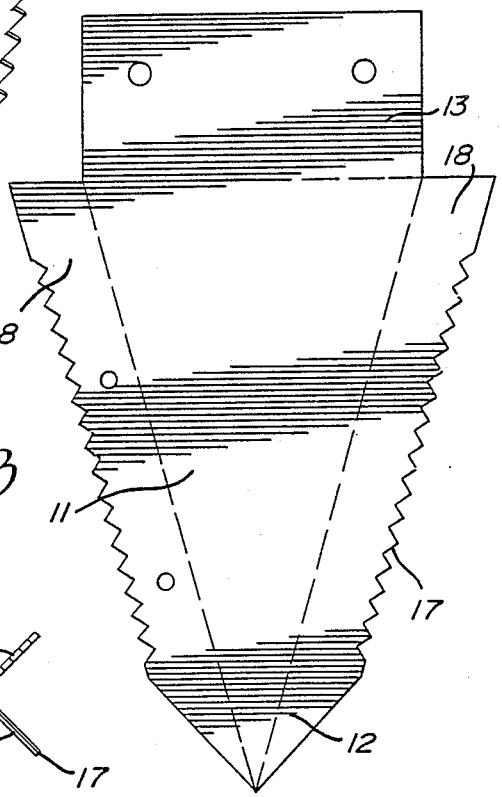
FIG. 3 is a side view of a flat metal plate stamping utilized to form said boring implement.
Figure 2:
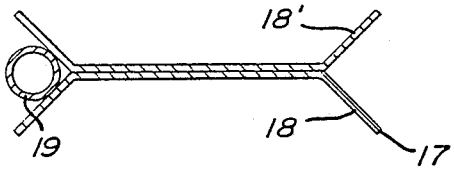
FIG. 2 is a cross-section view of the boring implement.
Figure 6:
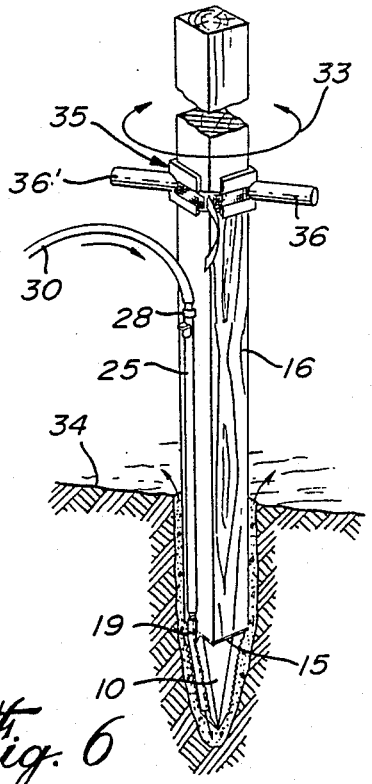
FIG. 6 a perspective view showing the post hole digger in use.

Referring now to the drawings, and more particularly to FIGS. 1 to 3, there is shown generally at 10 the hole boring implement of the present invention The implement is constructed of steel metal plates 11 of substantially V-shaped configuration and which are welded back-to-back, as shown in FIG. 2. Each of the metal plates is formed with a piercing free end 12 and an attachment means in the form of an attachment flange 13 is formed at the opposed top end thereof. The attachment flanges are bent at right angles and provided with holes 4 whereby to secure the implement in the bottom end 15 of a post 16 as shown in FIG. 6.

Each of the metal plates is provided with serrated edges 17 in each opposed side thereof. An edge portion 18 of each of the sides is bent to extend angularly from the flat plane of the plate 11 into a common side thereof, as shown in FIG. 2 and project, in their top portion, outside the sidewalls 23 of a post 16 connected to the implement (see FIG. 1). When the plates are welded together, back-to-back, there is formed a pair of serrated edges in each opposed sides of the implement Each pair of edge portions 18 and 18' extending in diverging angular planes The V-shaped plates also terminate at an apex or pointed end to constitute the piercing free end 12.

A conduit means in the form of a pipe section 19 is secured between one of the pairs of diverging edge portions 18 by weld spots 20. The pipe section 19 has a bottom open end 21 terminating substantially above the end portion 12. As can be seen in FIGS. 1 and 3, the end portion 12 is provided with straight angulated side edges 12' which terminate at the apex 12''. The top open end of the pipe section 19 is shown at 22 and it terminates above the right angle flanges 13 so that it lies adjacent a bottom portion of the side wall portion 23 of a post 16 connected thereto.

Figure 4:
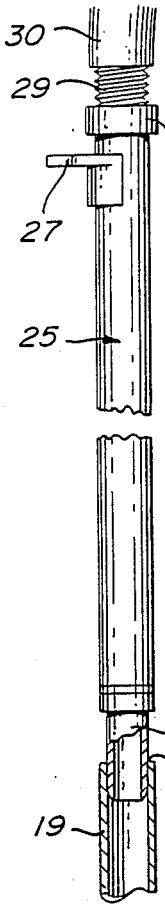
FIG. 4 is a simplified fragmented side view of a disconnectible pipe section secured to the pipe sections of the implement.

Referring now to FIG. 4, there is shown a pipe or conduit 25 provided with a pressure-fitted adaptor 26 at one end thereof for connection into the top open end 22 of the pipe section 19 secured to the boring implement 10. A bayonnette type connector could replace the adaptor 26 for a more secure connection, if desired. The pipe section 19 is preferably a rigid pipe but may be made as a flexible pipe. A retracting flange 27 may also be secured to the pipe in a top end portion thereof. A hose coupling 28 is secured to the top end of the pipe 25 whereby to secure the connector 29 of a garden hose 30 therein.

Figure 7:
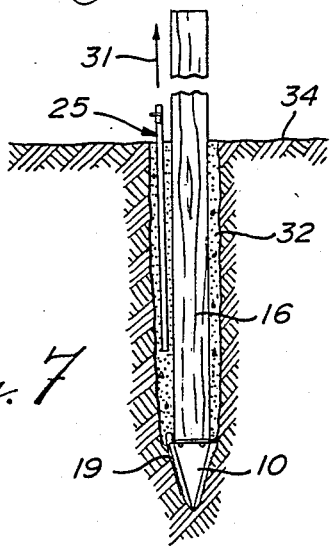
FIG. 7 is a side view showing the post implanted in the ground with the hydraulic water hose being disconnected therefrom.

After the post has been implanted in the ground, as shown in FIG. 7, the pipe section 25 is retracted by an upward pulling force applied to the pipe in the direction of arrow 31 If a bayonnette connector is used, the pipe is rotated to disconnect prior to its retraction This causes the pressure-fit connector 26 to disconnect from the top end of the pipe section 19 secured to the boring implement 10 Because the ground around the post, in the section 32 is very wet due to the water having been injected in the hole during the boring process, the pipe is easily retracted and the earth around the post cavitates into the bored hole left by the pipe during its retraction.

Figure 5:
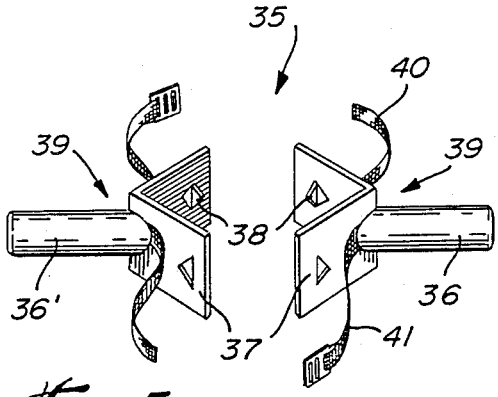
FIG. 5 is a perspective view of a handle mechanism securable to the post to impart axial rotation thereof.

In order to bore the post into the ground, it is necessary to impart axial rotation and counter-rotation to the post, as shown by the arrow 33. This rotation is preferably imparted by securing a pair of handle bars 35, as better illustrated in FIG. 5, to the post at a comfortable height above the ground surface 34. As shown in FIG. 5, the handle bar mechanism 35 is herein comprised by a pair of handles 36 each secured to a right angle V-shape flange 37. The flange may have one or more cripping elements 38 formed therein to prevent the slipping about the post when secured thereto, particularly if the post is circular. Each of the handle sections 39 is further provided with a strap section 40 and a strap and buckle section 41 secured to respective side of the handle 36 and 36' to interconnect the handle mechanism about the post Other suitable attachment means may be provided to interconnect the handle bars 36 and 36' to the post As the post descends due to the reciprocal axial movement imparted thereto, the handle mechanism may be quickly disconnected and reconnected higher on the post so that a person can work at a comfortable level when standing on the ground surface 34

Summarizing the operation or the method of implanting a post with the boring implement of the present invention secured thereto, it is firstly necessary to secure the boring implement to the bottom end of the post by inserting nails through the holes 14 provided in the right angle flanges 13. After that is done, the conduit section 25 is connected in the top end 22 of the pipe section 19 by applying pressure so as to provide a press-fit connection. A garden hose 30 is then connected to the top end of the conduit section 25. The post is then positioned at a desired location on the ground surface and the garden hose water supply is turned on. Thus, a jet of low-pressure water, (usually 35 p.s.i.) emanates from the bottom end 21 of the pipe section 19 in the direction of the piercing end of the implement 10. The low-pressure water supply is sufficient to soften to earth to assist in the boring without destroying the hole being bored. The handle mechanism 35 having been secured to the post it then imparts a reciprocal axial movement to the post which then causes the implement to bore into the ground by means of the toothed serrated edges in the edge portions of the implement. In order to provide boring action totally about the hole to be formed, it is necessary to turn the post at least through a 90° angle in counter-directions The post then descends into the ground with a hole being formed with water impregnated material all about the post. After the post has been descended to the desired height, the conduit section 25 is pulled out of the hole by an upward pulling force. This may be done while water pressure still flows through the water conduit section to facilitate the retraction thereof If the ground around the post is substantially impregnated with water, the water pressure can be shut off before the retraction thereof.

It is within the ambit of the present invention to cover any obvious modifications of the preferred embodiment described therein For example, the boring implement 10 may be provided as a single flat plate having the outer edge portion thereof bent angularly outwards in opposite angular directions and being serrated. With this type of a boring implement it would be necessary to rotate the post at least 180° in each direction in order for the teeth to travel about the entire circumference of the hole being bored. Also, in an other modification, the teeth 17 may extend at diverging angles along the edge portion 18 instead of being disposed in the same plane as the plate edge portion.

We claim:

1. A post hole digger comprising a boring implement having a piercing free end and an attachment means at an opposed end for securement to a bottom end of a post to be secured in the ground, said implement having a tapered body section with a projecting serrated edge on opposed sides thereof, said serrated edges extending angularly from a common longitudinal plane and in opposed planar angular directions, there being a pair of said serrated edges in each said opposed sides, each edge of said pair extending in diverging angular planes, and conduit means secured to said implement to direct a liquid flow in the direction of said piercing free end.

2. A post hole digger as claimed in claim 1 wherein said conduit means is a pipe section secured between said serrated edges of one of said pairs of serrated edges.

3. A post hole digger as claimed in claim 2 wherein said body is a flat plate having a V-shape taper defining angulated side edges and an apex, said apex constituting said piercing free end, said pair of serrated edges extending along at least a portion of a respective one of said angulated side edges.

4. A post hole digger as claimed in claim 2 wherein said body is formed by two V-shaped metal plates each having inwardly turned edges portions extending on a common side of said plates, said metal plates having a right angle flange formed integral therewith in a top end portion thereof, the opposed end portion terminating in a pointed end portion constituting said piercing free end, said plates being welded together back-to-back with said flanges and turned edge portions extending in opposed directions, said pipe section being welded between two of said opposed turned edge portions, said turned edge portions extending beyond the diameter of a post secured to said flanges in a top end portion thereof.

5. A post hole digger as claimed in claim 4 wherein said pointed end portion is a V-shaped end portion having straight angulated side edges and a pointed apex, said pipe section having a bottom open end terminating substantially above said end portion and in the direction thereof and a top open end extending above said right angle flanges.

6. A post hole digger as claimed in claim 1 wherein said conduit means is a pipe section secured between said serrated edges of one of said pairs of serrated edges, a conduit connected at one end to a top open end of said pipe section by a pressure fit adapter which is disconnectible by a predetermined movement of said conduit.

7. A post hole digger as claimed in claim 6 wherein said conduit has a hose connector secured to a top end thereof for connection to a garden hose.

8. A post hole digger as claimed in claim 1 wherein there is further provided handle means removably connectible to said post for imparting axial rotation and counter-rotation movement to said post to cause said implement to bore a hole under said post.

9. A post hole digger as claimed in claim 8 wherein said handle means comprises a pair of handle bars having post engagement means for engagement with a post to be implanted in the ground, and attachment means for securing said handle means on opposite sides of said post.

* * * * *